US012146678B2

(12) United States Patent
Schabbach et al.

(10) Patent No.: US 12,146,678 B2
(45) Date of Patent: Nov. 19, 2024

(54) GRILLE FOR VENTILATION APPARATUS

(71) Applicants: SPRINGER CARRIER LTDA., Canoas (BR); CLIMAZON INDUSTRIAL LTDA., Manaus (BR); MIDEA DO BRASIL—AR CONDICIONADO LTDA., Joinville (BR)

(72) Inventors: Rafael Schabbach, Canoas (BR); Carlos Afonso Tesche, Canoas (BR); Luciano Da Luz Moraes, Canoas (BR); Peter Torres Romancini, Canoas (BR); José Ricardo Herrmann Baumbach, Canoas (BR); Felipe Osmar Berwanger Brochier, Canoas (BR); Jonathan Gustavo Da Silva, Canoas (BR)

(73) Assignees: SPRINGER CARRIER LTDA. (BR); CLIMAZON INDUSTRIAL LTDA. (BR); MIDEA DO BRASIL—AR CONDICIONADO LTDA. (BR)

( * ) Notice: Subject to any disclaimer, the term of this patent is extended or adjusted under 35 U.S.C. 154(b) by 291 days.

(21) Appl. No.: 17/418,659

(22) PCT Filed: Dec. 28, 2018

(86) PCT No.: PCT/BR2018/050487

§ 371 (c)(1),
(2) Date: Jun. 25, 2021

(87) PCT Pub. No.: WO2020/132722

PCT Pub. Date: Jul. 2, 2020

(65) Prior Publication Data

US 2022/0057104 A1 Feb. 24, 2022

(51) Int. Cl.
*F24F 13/08* (2006.01)
*F04D 29/70* (2006.01)

(52) U.S. Cl.
CPC ..... *F24F 13/082* (2013.01); *F04D 29/703* (2013.01)

(58) Field of Classification Search
CPC ..... F24F 13/082; F04D 29/703
See application file for complete search history.

(56) References Cited

U.S. PATENT DOCUMENTS 4,202,409 A 5/1980 Cann et al.
4,858,683 A 8/1989 Beehler
(Continued)

FOREIGN PATENT DOCUMENTS

CN 103574775 A 2/2014
CN 104344526 A 2/2015
(Continued)

OTHER PUBLICATIONS

International Search Report Issued in International Application No. PCT/BR2018/050487, dated Aug. 8, 2019, 3 pages.

*Primary Examiner* — Justin D Seabe
*Assistant Examiner* — John S Hunter, Jr.
(74) *Attorney, Agent, or Firm* — Dilworth IP, LLC

(57) ABSTRACT

A grille for ventilation apparatus arranged downstream of insufflation elements of a ventilation apparatus, the grille including a grid portion arranged upstream of a stator portion. The insufflation elements may include a fan. The grid portion may include fins which form concentric rings.

13 Claims, 6 Drawing Sheets

Detail X

(56) References Cited

U.S. PATENT DOCUMENTS

| | | | | |
|---|---|---|---|---|
| 6,503,060 | B1 * | 1/2003 | Kamada | F24F 13/082<br>415/121.2 |
| 2017/0343016 | A1 | 11/2017 | Kim et al. | |

FOREIGN PATENT DOCUMENTS

| | | | |
|---|---|---|---|
| CN | 106642371 | A | 5/2017 |
| CN | 207122442 | U | 3/2018 |
| GB | 2436865 | A | 10/2007 |
| JP | 4936251 | B2 | 5/2012 |
| WO | 2016116871 | A1 | 7/2016 |
| WO | 2017078513 | A1 | 5/2017 |

* cited by examiner

Detail X

Detail Y

GRILLE FOR VENTILATION APPARATUS

FIELD OF THE INVENTION

The present patent of invention belongs to the field of apparatus and devices for air-cooling and ventilation, more specifically air conditioner apparatus and fans.

BACKGROUND OF THE INVENTION

The present invention relates to an air insufflation grille with a built-in stator, for application in apparatus having ventilation elements, wherein said grille performs both the protection and support function inherent to grilles of this nature, as well as the function of recovery of part of the dynamic pressure of the air that passes through the grille coming from the air insufflator of the apparatus for which it is intended.

The grille according to the invention allows a significant increase in the airflow of the respective equipment for the same angular speed of its insufflator, such flow increase reaching close to 30% in relation to its peers known in the prior art.

Various configurations of grids or grilles for ventilation apparatus of the nature described above are known in the prior art.

An example is the solution disclosed by patent document U.S. Pat. No. 4,858,683 which relates to a cover for an air conditioning condenser unit that is formed from a single unitary sheet of material. The cover includes a peripheral portion, a central portion and an undivided annular portion located between the peripheral and central portions. The peripheral, central and annular portions are usually coplanar. A first set of fins interconnects the central portion and the annular portion. A second set of fins connects the annular portion and the peripheral portions. The angle of inclination of the fins in relation to the cover plane varies along the length of the fins.

From the reading of the patent document U.S. Pat. No. 4,858,683, and based on the figures of such application, it may be noted that the single-piece structure proposes to solve a series of problems, however it ends up triggering others. One of them is product maintenance, since the fin structure offers greater fragility, as it cannot withstand greater pressure in situations such as stacking products or accidents involving weights or pressures exerted on the grid. In addition, there is no mention in U.S. Pat. No. 4,858,683 regarding the cleaning of the cover and its possible disassembly in order to facilitate this cleaning. Such a device is susceptible to accumulation of dust and various other types of debris. Thus, it may be understood that the cleaning processes are hampered by the fins, and further complicated by the difficult access and disassembling of the cover.

Finally, the fact that U.S. Pat. No. 4,858,683 seeks to protect tilt angles for the fins thereof is unsatisfactory upon reading U.S. Pat. No. 4,858,683, once references to angles and how they should relate to possibly solve prior art problems are few and vague.

Another pertinent prior art solution is presented by the US patent document number US20170343016, which discloses a protection grid set and a corresponding external air conditioning unit, having a front panel, a fan protector including a hub provided at the exit to directly attach a fan motor set and a rib arranged between the hub and the front panel. In addition, the exterior unit according to this document includes a cabinet, a bell mouth provided in the cabinet, a fan guard provided at a bell mouth exit, and a fan motor set attached to the fan guard.

The solution of US20170343016 intends to both provide a grid capable of offering less resistance to the airflow of a fan and to provide a robust grid construction capable of ensuring rigidity to steadily support a fan and a motor in an external air conditioning unit. Although it mentions the increasing tilt angles of the blades and the variation in the heights of their cross sections as features capable of optimizing the airflow that passes through the grid, especially the cross sections have a concave face (faces S1, S2, S3 of the FIG. 9 of US20170343016), while the opposite faces are straight. Thus, the US20170343016 grille does not have the stator function, since the aerodynamic profile of its blades does not serve to redirect the airflow in order to recover part of the kinetic energy contained therein.

Several other prior art devices, such as those presented by U.S. Pat. No. 4,202,409, WO 201778513 and JP4936251 keep exhibiting common problems throughout the prior art. Many devices and solutions presented have grids or bars which arrangement and/or angulation prevents the best drainage or airflow. In addition, the use of materials which cleaning and maintenance are hampered for a number of reasons is common, such as grids having very narrow openings and cutouts or yet difficulties in removing the grid from the main body they are attached to. Consequently, complex or difficult maintenance and cleaning can become costly.

There is, therefore, space for an improved grille for ventilation apparatus that eliminates the problems pointed out in the prior art, and that, additionally, provides savings in resources, besides safety and convenience to its end user.

SUMMARY OF THE INVENTION

The purpose of the present invention patent is, therefore, to provide a grille for a ventilation apparatus, in which said grille has, in a single body, a built-in stator, exerting both the function of protection and support as well as the function of recovery of the dynamic pressure of the air passing through the grille.

BRIEF DESCRIPTION OF THE FIGURES

For better understanding and visualization of the object of the present invention patent, the same will now be described with reference to the attached drawings, representing the functional improvement obtained, wherein, schematically.

DETAILED DESCRIPTION OF THE INVENTION

Figure 1:
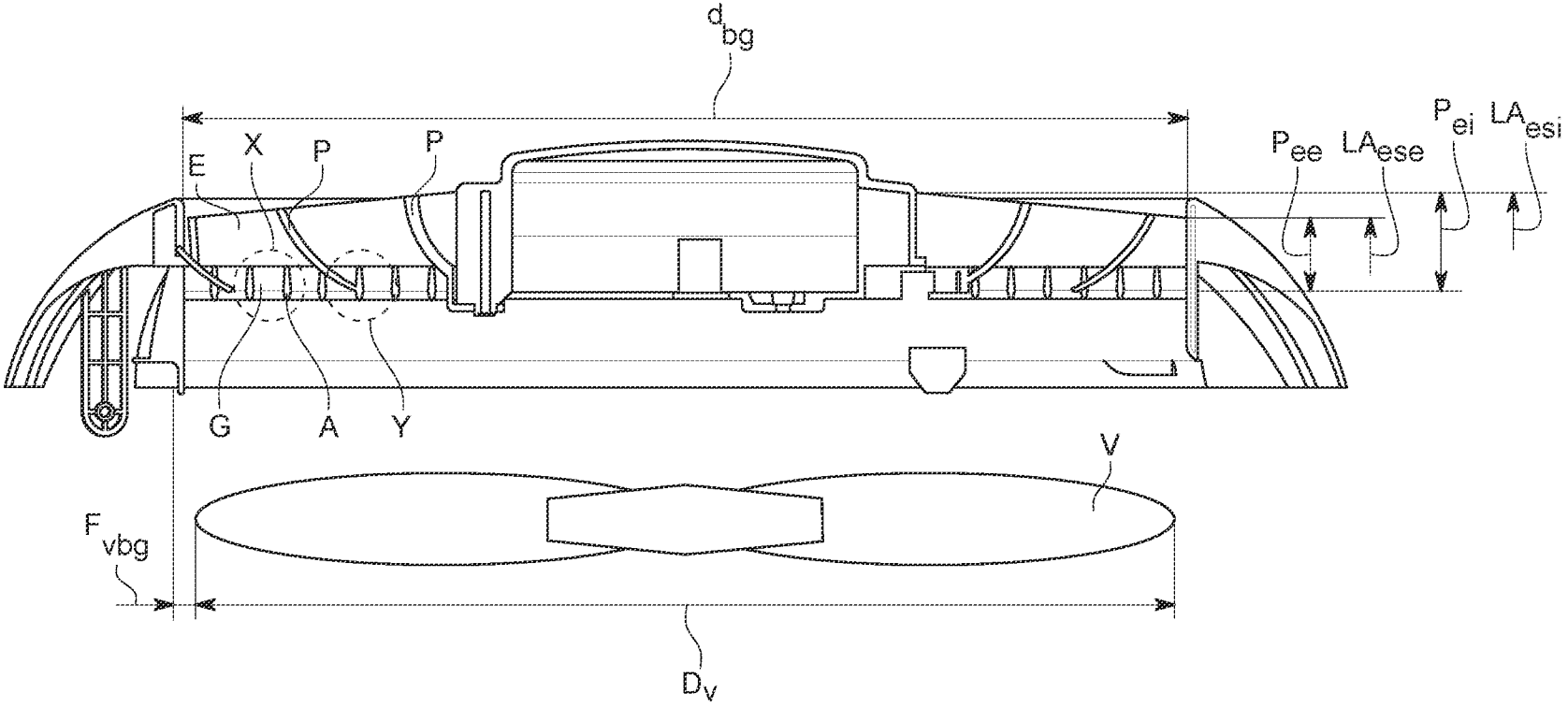
FIG. 1 shows a side view in partial section of a grille for ventilation apparatus according to the invention patent, mounted downstream of an insufflation device of a ventilation apparatus.
Figure 2:
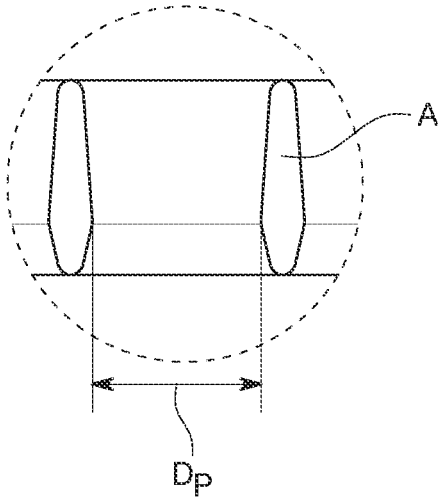
FIG. 2 shows an enlarged side view of detail X of FIG. 1.
Figure 3:
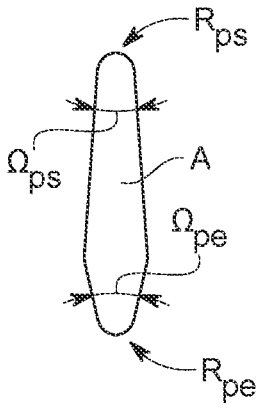
FIG. 3 shows an enlarged side view of a grid fin according to the present invention.
Figure 4:
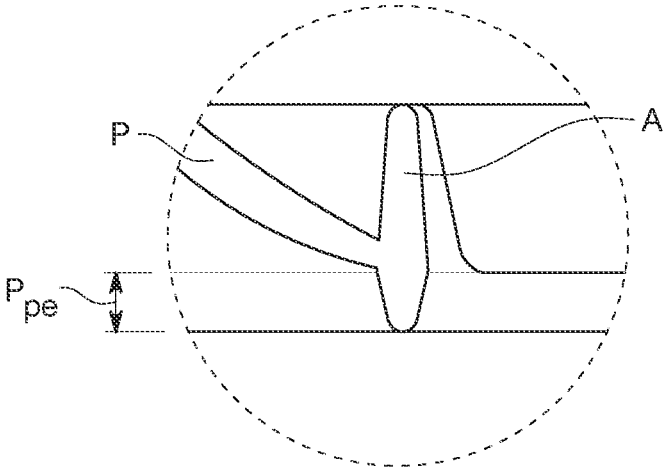
FIG. 4 shows an enlarged side view of detail Y of FIG. 1.
Figure 5:
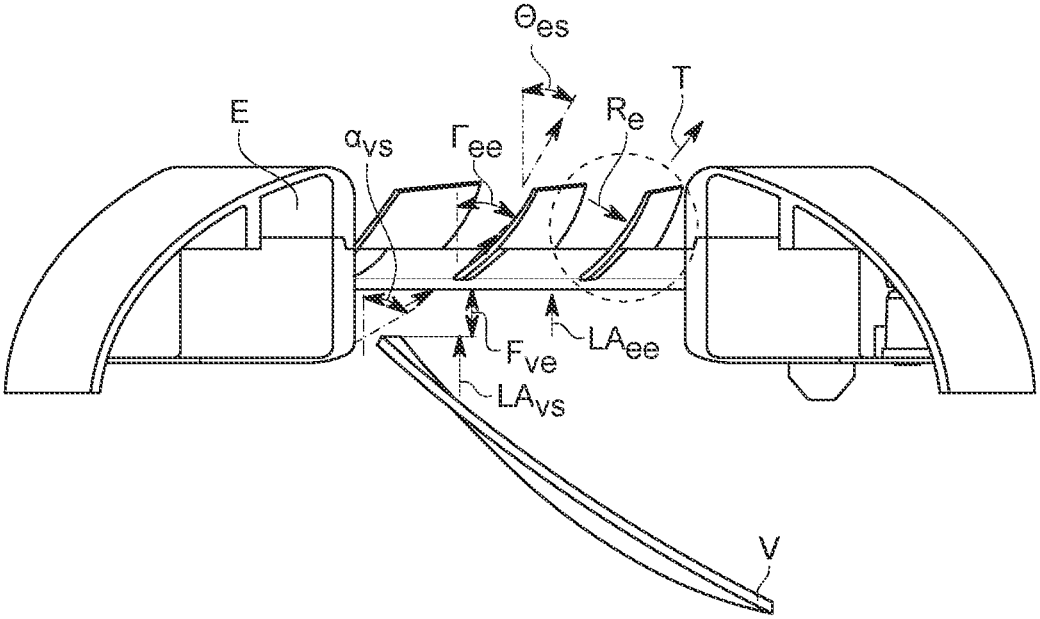
FIG. 5 shows a side view in partial section of the stator of the grille of FIG. 1.
Figure 6:
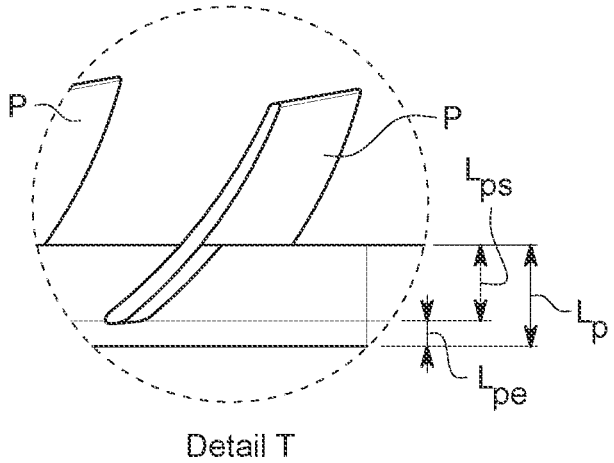
FIG. 6 shows a side view of detail T of FIG. 5.
Figure 6A:
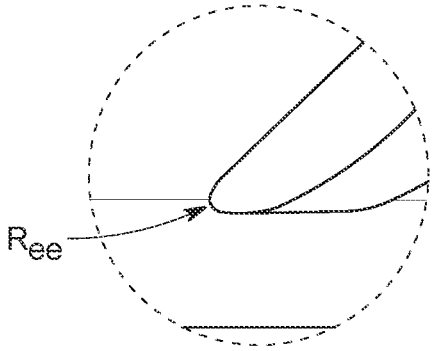
FIG. 6*a* shows an enlarged side view of detail T of FIG. 5, more specifically of the lower part of a stator blade according to the invention.
Figure 6B:
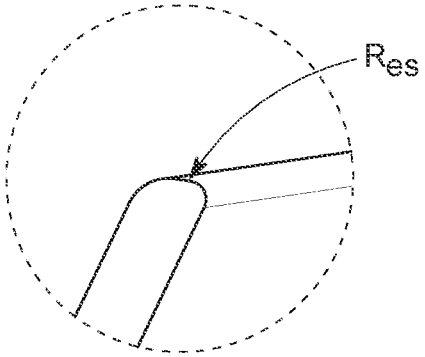
FIG. 6*b* shows an enlarged side view of detail T of FIG. 5, more specifically of the upper part of a stator blade according to the invention.
Figure 7:
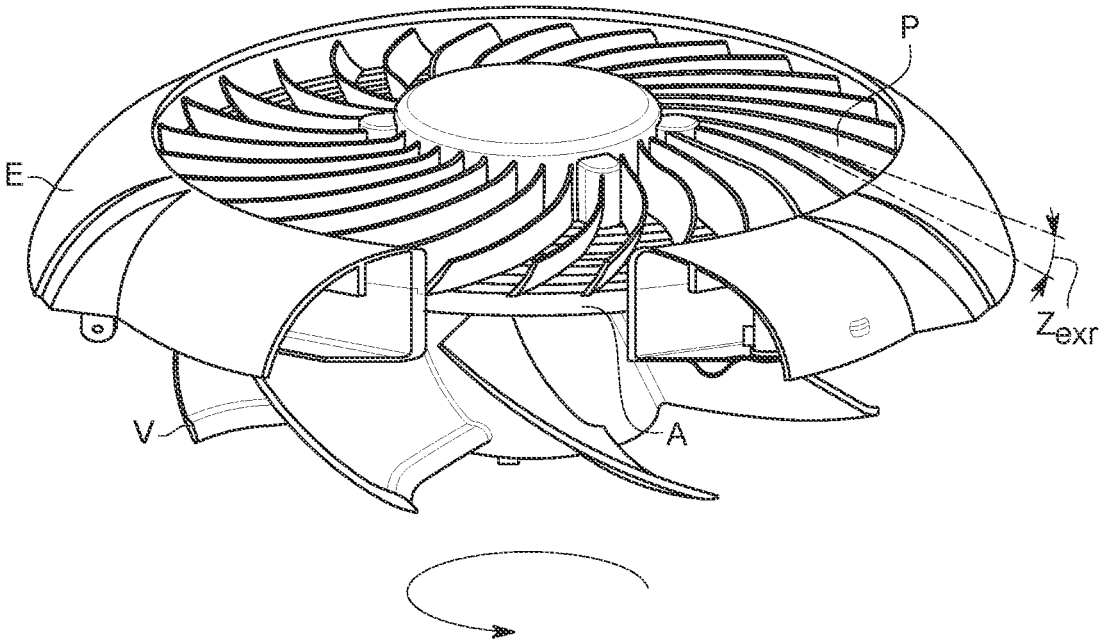
FIG. 7 shows an upper-front perspective view of the grid of FIG. 1, mounted downstream of an inflation device of a ventilation apparatus.
Figure 8:
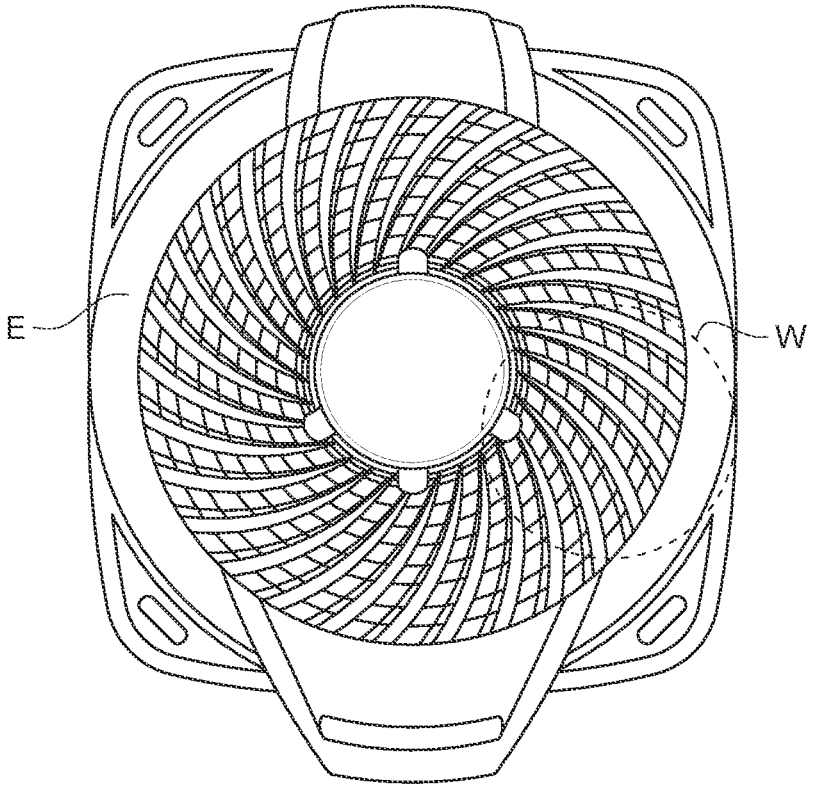
FIG. 8 shows a top view of a grille for a ventilation apparatus according to the invention patent, mounted on a ventilation apparatus.
Figure 9:
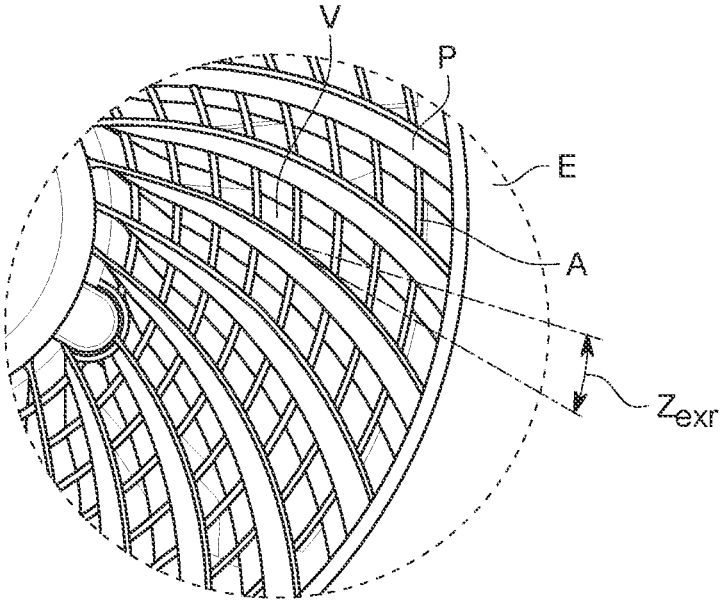
FIG. 9 shows an enlarged side view of the detail W of FIG. 8.
Figure 10:
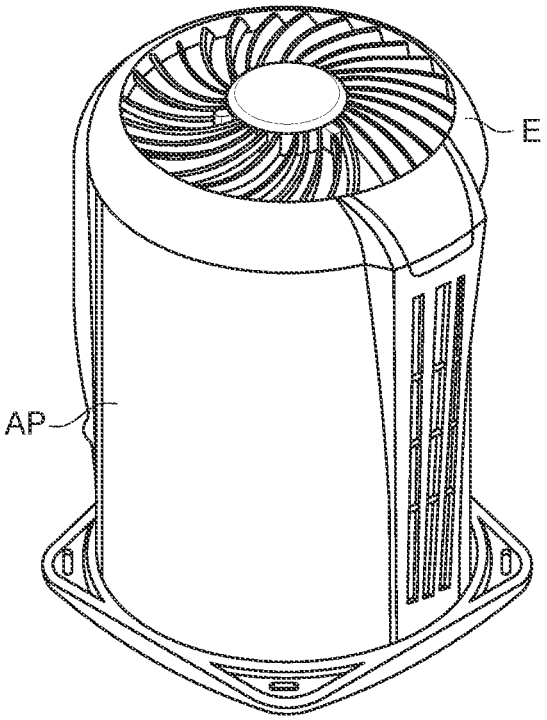
FIG. 10 shows a perspective view of a ventilation apparatus provided with a grille according to the invention.

A grille for ventilation apparatus or just grille, according to the invention patent, is a single-body grille, arranged downstream of the insufflation element (V) of a ventilation apparatus (AP), basically comprising a grid portion (G) and a stator portion (E).

The grid portion (G) is formed by radial and concentric fins (A), forming concentric rings or radial ribs, and arranged upstream the stator portion (E), i.e., beside the inflation element (V), represented herein by a fan (V). The grid portion (G), in addition to configuring the safety element to prevent access to the rotating and/or internal pieces of the apparatus (AP), forms the beginning of the stator (E) and its fins (A) are the initial part of air conduction of the blades (P) of the stator (E), wherein the fins (A) have an airfoil profile which objective is to increase the efficiency of the recovery of the dynamic air pressure coming from the fan (V), transforming it into static pressure obtained by reducing the circumferential component of the fan exit speed (V). In addition, it should be noted that the fins (A) must have an adequate shape to allow the injection of this piece and its removing, with a minimum cost (height of the concentric rings) and a minimum of material loss (conical shape in the entry and exit form). The shape of the fins (A) can be, for example, but not limited to an asymmetrical prism shape or other suitable profile, preferably with tilt faces.

The stator portion (E) is formed by blades (P) that extend radially from the grid center (internal part) to its periphery (external part), having an airfoil profile on both faces or leading edges thereof.

When leaving the fan (V), the total airflow speed is composed of an axial component that defines the airflow and a circumferential component, resulting from the angular movement of the fan (V). Through the curvature of the blades (P) of the stator (E) the circumferential component is reduced and its kinetic energy is partially transformed into static pressure. Thus, the static pressure that the fan (V) must overcome is reduced because the pressure at its exit is lower than the ambient pressure (external to the grille), since there is an increase in static pressure in the grille/stator and the static pressure will become equal to the ambient pressure again only from the grille exit.

Thus, the fan (V) works at a static pressure ratio entry versus exit lower than the ratio at which it would work without the presence of the stator (E) and, consequently, a significant increase in airflow is obtained.

The value of flow increase promoted by the grille according to the invention varies according to the dimensioning of the grille/stator (E) and fan (V).

In tests carried out in a split-type air conditioning condenser, operated with a grid known from the prior art and then with a grid according to the invention, the increase in the exit airflow from the grille increased by more than 15%, reaching, in tests carried out on simpler equipment in terms of design and with optimized dimensional and aesthetic features, in laboratory, to increases of more than 25% of the air volume per unit of time in relation to conventional grids.

The technical effect of the combination of safety and increased airflow, possible through the object of the present invention, results from a simple, yet efficient and effective design, represented and demonstrated below based on the abovementioned example, but, of course, without being limited to it.

The fan (V) has an external diameter ($D_v$) which, in relation to an internal diameter of the grille nozzle ($d_{bg}$), is such that a gap ($F_{vbg}$) is established between the fan and the grille nozzle that corresponds to half the difference between the internal diameter of the grille nozzle ($d_{bg}$) and the external diameter ($D_v$), namely:

$$Fvbg = \frac{(dbg - Dv)}{2}$$

Typical values for the clearance ($F_{vbg}$) in the non-limiting example of the present invention range between 1 and 50 millimeters, preferably 7 millimeters, depending, of course, on the type of equipment used.

Still on the fan (V), it should be noted that an axial position of the fan exit edge ($LA_{vs}$), an axial position of the stator entry edge ($LA_{ee}$), an axial position of the stator exit edge on the external radius ($LA_{ese}$), as well as an axial position of the stator exit edge in the internal radius ($LA_{esi}$) are such that a gap is established between the fan exit edge and the stator entry edge ($F_{ve}$) which is equivalent to the difference between the axial position of the stator entry edge ($LA_{ee}$) and an axial position of the fan exit edge ($LA_{vs}$), representing values between 1 and 30 millimeters, preferably 15 millimeters depending, of course, on the type of equipment used. Therefore:

$$Fve = LAee - LAvs$$

In addition, the above measurements determine a stator depth in the external radius ($P_{ee}$) equivalent to the difference between the axial position of the stator exit edge in the external radius ($LA_{ese}$) and the axial position of the stator entry edge ($LA_{ee}$), as well as a stator depth in the internal radius ($P_{ei}$) which corresponds to the difference between the axial position of the stator exit edge in the internal radius ($LA_{esi}$) and the axial position of the stator entry edge ($LA_{ee}$). Therefore:

$$Pee = LAese - LAee$$

$$Pei = LAesi - LAee$$

Typical values for the stator depth in the external radius ($P_{ee}$) and a stator depth in the internal radius ($P_{ei}$) rotate between 10 to 300 mm, being, in this example, 25 mm for the stator depth in the external radius ($P_{ee}$) and 35 mm for the stator depth in the internal radius ($P_{ei}$). Apart from the discussion of ideal numerical values, it is important to note that, in practice, the depths ($P_{ee}$, $P_{ei}$) and grille dimensions in general are subject to dimensional restrictions imposed by the design as a whole and, in particular, limited by the costs involved in tooling, material, transport, assembly etc. As an interesting relationship, it has been shown to dimension the grille with a height (or depth) of a dimension equivalent to 1 to 2 times the height (axial measurement) of the fan.

As described above, the airflow in motion reaches the grille at an angle of the (total) air speed in relation to the axial direction in the flow course at the fan exit edge ($\alpha_{vs}$), reaching the blade (A) of the stator (E) at an angle of the stator entry edge in relation to the axial direction in the flow course ($\Gamma_{ee}$), thus an angular offset exists between the (total) air speed angle in the fan exit edge ($\alpha_{vs}$) and the angle of the stator entry edge ($\Gamma_{ee}$), and here, for completeness purposes only, it is called lag ($\beta_{ve}$), but not being represented in the figures:

$$\beta ve = \Gamma ee - \alpha vs$$

The lag value ($\beta_{ve}$), yet in the example shown, varies between −15° and +15°, being preferably close to zero.

The angle of the exit edge ($\Theta_{es}$) of the stator (E) in relation to the axial direction in the flow course must be smaller than the angle of the stator entry edge ($\Gamma_{ee}$) and close to or equal to zero, preferably, in the present example, an ideal stator entry edge angle ($\Gamma_{ee}$) would be 10° (ten degrees), which approximates the maximum dynamic pressure recovery.

The stator (E) blades (P) are such that the curvature radius of the stator blade ($R_e$) is around 10 to 1,000 mm, being, in the given example, preferably approximately 60 mm, depending on the dimensioning of said apparatus (AP), being, under these conditions, the number of stator blades ($N_e$) a direct function of the grille diameter, which can vary from 2 to 100 blades (P) per grille, being, in the present case, of 30 blades (P). However, the theoretical ideal number of blades (P) is approximately 1 to 2 times the number of fan blades (V), which would mean, for example, for a fan (V) with 4 blades, a stator with 8 blades (P). Although this is an ideal value for maximum pressure recovery, strong dimensional, structural, safety and aesthetic restrictions raise this number to around 30 in the case of our example, which can obviously vary according to the aforementioned conditions.

In the course of the fan airflow (V), each blade (P) has a stator entry edge radius ($R_{ee}$)—or a compatible airfoil profile—as well as a stator exit edge radius ($R_{es}$), with values compatible with the given example in the range between 0.1 and 20 mm, preferably of approximately 1 mm.

An important feature of the blades (P) according to the invention is the continuous variation of its curvature from the center of the grille to its external periphery, here called the expansion factor of the stator blades in the radial direction ($Z_{exr}$), which represents the variation of the angular unit per unit of length of each of the blades, being expressed in degrees per millimeter. Suitable values range from −10°/mm and +10°/mm, preferably −0.2°/mm, which is to say that the ideal angle for the external radius would be approximately 30°.

The fins (A) of the grille according to the invention, arranged in the grid portion (G), in addition to having the function of protection against accidents with internal and/or moving pieces of the apparatus (AP), form the beginning of the stator (E) as the initial air-conduction part for the blades (P) of the stator (E).

The concentric rings formed by the fins (A) of the grid portion (G) have a depth of protection rings ($L_p$) ranging between 2 and 50 mm, preferably approximately 10 mm, also having a depth of the entry edge of the protection rings ($L_{pe}$)—with values between 2 mm and 20 mm, preferably 3 mm—and a depth of the exit edge of the protection rings ($L_{ps}$)—this with typical values for the present example between 2 mm and 30 mm, preferably 7 mm.

The aspect ratio ($Z_p$) between the depth of the entry edge ($L_{pe}$) and of the exit edge ($L_{ps}$) of the protection rings is such that the quotient between these quantities is from 0.1 to 2.0, preferably from 0.4, namely:

$$Zp = \frac{Lpe}{Lps}$$

The minimum clearance ($D_p$) between the protection rings, which is equivalent to the distance between the points of greatest width of two adjacent protection rings, must be between 2 mm and 50 mm, and in the non-limiting example of the invention, being preferably approximately 8 mm, that is, the minimum clearance ($D_p$) can vary between 0.1 and 15% of the value of the external diameter ($D_v$) of the fan (V), being preferably 5% of ($D_v$).

The relative position between the protection rings entry edge and the stator entry edge in the axial direction of the airflow ($P_{pe}$) course is such that it is greater than or equal to the depth of the entry edge ($L_{pe}$), since less than this affects the shape (greater losses) due to injection restrictions, and less than the stator depth in the external radius ($P_{ee}$) or the stator depth in the internal radius ($P_{ei}$), preferably being equal to approximately the depth of the entry edge ($L_{pe}$), which means that the stator entry edge is in the position of the transition between the entry edge and exit edge of the protection ring (the point of greatest width of the protection ring.

Each fin (A) that forms the protection rings also has an entry edge taper ($\Omega_{pe}$) of 5° to 120°, preferably of approximately 35°, an exit edge taper ($\Omega_{ps}$) of 5° to 120°, preferably of approximately 30°, in addition to an entry edge radius ($R_{pe}$) and an exit edge radius ($R_{ps}$), both between 0.5 mm and 10 mm, being, in the given example, preferably approximately 1 mm.

It should be noted that the present invention is not limited to the concept presented and extends to all design possibilities that integrate a discharge grille to a stator including the repositioning of the protection grid through or at the grille exit. It is also not limited to application in a split air conditioner condenser and it can be used in condensers of different types (chillers, selfs, etc.) of various capacities and formats, in addition to other equipment such as table or wall or ceiling fans, heaters, air insufflators, room humidifiers, vehicle ventilation systems etc.

A grille according to the invention can be manufactured in any material usual for use in grids and grilles of this nature, as well as polymers, metals, fibers and other suitable materials, but not being restricted to these.

Another important disadvantage of the prior art is overcome by the present invention, since the grille can be easily removed from the main body of the apparatus (AP) to which it is attached, both for cleaning operations and for periodic maintenance.

Another obvious advantage is that the present grille for ventilation apparatus provides savings on energy sources (such as electricity or fuel for driving a generator) since practical tests have proven that the inventive concept of using a grid portion (G) upstream of a stator portion (E), enables airflow performance improvements close to 30%.

It is also to be noted that the present grille for ventilation apparatus can be adapted to different types of apparatus since the dimensional variations required for adaptation to different oven sizes are not beyond the scope of the present object.

Finally, it is also clear that the present invention exhibits low construction and maintenance costs, eliminating the use of additional devices such as support and adjustment members, locks or additional structures.

It is evident that the measurements and relations between measurements described for the present invention may vary according to the dimensioning of the grille for ventilation apparatus.

Exhaustive practical tests, however, have shown that these dimensions and their relationships are highly efficient and effective in the safety and practicality provided by the grille for ventilation apparatus.

It will be easily understood by those skilled in the art that changes can be made in the present invention without departing from the concepts exposed in the above description. These modifications must be regarded as included in the scope of the present invention. Consequently, the particular embodiments detailed above are only illustrative and exemplary and not limiting as to the scope of the present invention, to which the full extent of the appended set of claims must be observed, and any and all correspondents thereof.

The invention claimed is:

1. A grille for ventilation apparatus, arranged downstream of insufflation elements of ventilation devices, comprising a grid portion arranged upstream of a stator portion, wherein the grid portion includes fins which form protection rings, and wherein an aspect ratio ($Z_p$) between a depth of an entry edge ($L_{pe}$) and of an exit edge ($L_{ps}$) of the protection rings is between 0.1 and 2.0.

2. The grille according to claim 1, wherein the grid portion and the stator portion form a single air-conducting body.

3. The grille according to claim 1, wherein the fins are radial and concentric and form concentric rings.

4. The grille according to claim 1, wherein the stator portion is formed by blades that extend radially from a center of the grid portion to a periphery of the grid portion, having an airfoil profile on both faces or leading edges thereof.

5. The grille according to claim 1, wherein the insufflation elements include a fan, the grille further comprising a gap ($F_{vbg}$) between the fan and a grille nozzle that corresponds to half a difference between an internal diameter of the grille nozzle ($d_{bg}$) and an external diameter ($D_v$) of the fan.

6. The grille according to claim 1, wherein the insufflation elements include a fan, wherein a minimum clearance ($D_p$) between points of greatest width of two adjacent protection rings varies between 0.1 and 15% of a value of an external diameter ($D_v$) of the fan.

7. A grille for ventilation apparatus, arranged downstream of insufflation elements of ventilation devices, comprising a grid portion arranged upstream of a stator portion, wherein the grid portion includes fins, and wherein each fin has an entry edge ($L_{pe}$) with an entry edge taper ($\Omega_{pe}$) and an exit edge ($L_{ps}$) with an exit edge taper ($\Omega_{ps}$), in addition to an entry edge radius ($R_{pe}$) and an exit edge radius ($R_{ps}$).

8. The grille according to claim 7, wherein an aspect ratio ($Z_p$) between a depth of the entry edge ($L_{pe}$) and of the exit edge ($L_{ps}$) is between 0.1 and 2.0.

9. The grille according to claim 7, wherein the grid portion and the stator portion form a single air-conducting body.

10. The grille according to claim 7, wherein the fins are radial and concentric and form concentric rings.

11. The grille according to claim 7, wherein the stator portion is formed by blades that extend radially from a center of the grid portion to a periphery of the grid portion, having an airfoil profile on both faces or leading edges thereof.

12. The grille according to claim 7, wherein the insufflation elements include a fan, the grille further comprising a gap ($F_{vbg}$) between the fan and a grille nozzle that corresponds to half a difference between an internal diameter of the grille nozzle ($d_{bg}$) and an external diameter ($D_v$) of the fan.

13. The grille according to claim 7, wherein the insufflation elements include a fan, wherein the fins form protection rings, wherein a minimum clearance ($D_p$) between points of greatest width of two adjacent protection rings varies between 0.1 and 15% of a value of an external diameter ($D_v$) of the fan.

* * * * *